US010062308B2

(12) United States Patent
Young

(10) Patent No.: US 10,062,308 B2
(45) Date of Patent: Aug. 28, 2018

(54) SYSTEM AND METHOD FOR PROVIDING A DECORATIVE LIGHTING DISPLAY

(71) Applicant: The Boeing Company, Chicago, IL (US)

(72) Inventor: Stephen M. Young, Mill Creek, WA (US)

(73) Assignee: The Boeing Company, Chicago, IL (US)

( * ) Notice: Subject to any disclaimer, the term of this patent is extended or adjusted under 35 U.S.C. 154(b) by 210 days.

(21) Appl. No.: 14/694,475

(22) Filed: Apr. 23, 2015

(65) Prior Publication Data

US 2016/0314726 A1 Oct. 27, 2016

(51) Int. Cl.
*G09F 13/00* (2006.01)
*G09F 13/22* (2006.01)
(Continued)

(52) U.S. Cl.
CPC ..... *G09F 13/22* (2013.01); *F21K 9/60* (2016.08); *F21K 9/90* (2013.01); *F21V 5/04* (2013.01); *F21V 13/02* (2013.01); *G09F 13/00* (2013.01); *G09F 13/06* (2013.01); *G09F 13/08* (2013.01); *G09F 21/10* (2013.01); *F21Y 2101/00* (2013.01); *G09F 2013/044* (2013.01); *G09F 2013/189* (2013.01); *G09F 2013/222* (2013.01)

(58) Field of Classification Search
CPC ..... G09F 13/22; G09F 2013/189; G09F 2013/1886; G09F 13/0409; G09F 13/08; G09F 2013/222; F21K 9/50
USPC ..... 362/604–605
See application file for complete search history.

(56) References Cited

U.S. PATENT DOCUMENTS 2,810,225 A * 10/1957 Hardesty ..... G02B 6/0021 40/473
5,232,388 A 8/1993 Danjell
(Continued)

FOREIGN PATENT DOCUMENTS

EP 2309477 A1 4/2011
WO 1999049441 A1 9/1999

OTHER PUBLICATIONS

Extended European Search Report, Application No. 16155972.9-1801, dated Sep. 27, 2016.

*Primary Examiner* — Sean Gramling
*Assistant Examiner* — Gerald J Sufleta, II
(74) *Attorney, Agent, or Firm* — Economou Silfin LLP; John S. Economou

(57) ABSTRACT

A decorative lighting display system and method are described for providing a halo lighting effect around one or more three-dimensional figures. A panel has a recess formed in a front portion thereof and an aperture formed in a portion of the recess. A lens and an associated mask having a predetermined pattern are mounted in the recess in the panel. A decorative laminate is applied on the front portion of the panel. One or more three-dimensional figures are mounted to the panel over the lens, associated mask and decorative laminate. The one or more three-dimensional figures have a two-dimensional cross-section, in a plane parallel to the front portion of the panel, which is slightly smaller than the predetermined pattern of the mask. A light source is mounted on the rear portion of the panel over the aperture and includes light elements which direct light through the lens and associated mask.

20 Claims, 9 Drawing Sheets

(51) Int. Cl.

| | |
|---|---|
| ***G09F 13/06*** | (2006.01) |
| ***G09F 13/08*** | (2006.01) |
| ***G09F 21/10*** | (2006.01) |
| ***F21K 9/90*** | (2016.01) |
| ***F21V 5/04*** | (2006.01) |
| ***F21V 13/02*** | (2006.01) |
| ***F21K 9/60*** | (2016.01) |
| *G09F 13/18* | (2006.01) |
| *G09F 13/04* | (2006.01) |
| *F21Y 101/00* | (2016.01) |

(56) References Cited

U.S. PATENT DOCUMENTS

| | | | | |
|---|---|---|---|---|
| 6,024,476 | A | 2/2000 | Wakeman | |
| 6,092,915 | A | 7/2000 | Rensch | |
| 6,113,149 | A * | 9/2000 | Dukatz | B42D 15/00 283/109 |
| 6,976,777 | B1 | 12/2005 | Herold | |
| 7,810,266 | B2 | 10/2010 | Arnthorsson | |
| 7,857,484 | B2 | 12/2010 | Marshall et al. | |
| 8,033,684 | B2 | 10/2011 | Marshall et al. | |
| 8,418,385 | B2 | 4/2013 | Olson | |
| 2004/0255497 | A1 * | 12/2004 | Venkataraman | G09F 13/04 40/551 |
| 2005/0213351 | A1 * | 9/2005 | Yang | B60Q 1/323 362/633 |
| 2006/0123678 | A1 | 6/2006 | Arvin | |
| 2007/0283604 | A1 | 12/2007 | Kaoh | |
| 2010/0154261 | A1 | 6/2010 | Bozlo et al. | |
| 2011/0052839 | A1 | 3/2011 | Pierce et al. | |
| 2012/0218761 | A1 * | 8/2012 | Lohneis | G09F 13/22 362/249.04 |

* cited by examiner

SYSTEM AND METHOD FOR PROVIDING A DECORATIVE LIGHTING DISPLAY

FIELD

This disclosure relates generally to a system and method for providing a decorative lighting display, and more particularly a system and method for providing a decorative lighting display that includes halo backlighting of three-dimensional figures such as letters and logos.

BACKGROUND

Decorative lighting displays frequently achieve a "halo" lighting effect by use use of high voltage neon, incandescence or fluorescence type lighting devices mounted behind three-dimensional figures such as letters and logos which are spaced from a rear surface so that the back illumination from these conventional light sources causes this "halo" lighting effect. These light sources require that the three-dimensional figures be sufficiently large in area so that the light sources are hidden behind the rear of the each three-dimensional figure. This traditional approach cannot be used with smaller three-dimensional figures. In addition, neon lighting devices are expensive, fragile, generate excessive heat in operation and require a high voltage power source. Incandescent and florescent lighting devices have a limited lifetime and require specialized lenses to generate the "halo" lighting effect and to provide a different colors of "halo" light.

Accordingly, there is a need for a decorative lighting display which provides a "halo" lighting effect and overcomes the problems recited above.

SUMMARY

In a first aspect, a decorative lighting display system includes a panel having a recess formed in a front portion thereof. The panel also has an aperture formed in a portion of the recess from the front portion of the panel to a rear portion thereof. The system also includes a lens and an associated mask mounted in the recess in the panel. The associated mask is configured to have a predetermined pattern. The system also includes one or more three-dimensional figures mounted to the panel over the lens and associated mask. The one or more three-dimensional figures have a two-dimensional cross-section, in a plane parallel to the front portion of the panel, that is slightly smaller than the predetermined pattern of the associated mask. The system further includes a light source mounted on the rear portion of the panel over the aperture therein. The light source includes light elements for directing light through the lens and associated mask.

In a further embodiment, the system may include a decorative laminate applied on the front portion of the panel to cover at least an area of the lens and associated mask. The decorative laminate may alternatively cover an area corresponding to an entire front portion of the panel. The one or more three-dimensional figures may be mounted flush against the panel over the lens and associated mask. The light elements in the light source may be LED devices. The LED devices may selectively emit different predetermined colors of light. The system may include a color filter having a predetermined color positioned adjacent to the lens. The lens may be formed from a plastic material which is tinted to a predetermined color. The lens may include mounting holes formed therein. The one or more three-dimensional figures may be mounted to the panel using the mounting holes in the lens.

In a second aspect, a method for forming a decorative lighting display is disclosed. A recess is formed in a front portion of a panel. An aperture is formed in a portion of the recess in the panel from the front portion of the panel to a rear portion thereof. A lens and an associated mask are mounted in the recess in the panel. The associated mask configured to have a predetermined pattern. One or more three-dimensional figures are mounted to the panel over the lens and associated mask. The one or more three-dimensional figures have a two-dimensional cross-section, in a plane parallel to the front portion of the panel, which is slightly smaller than the predetermined pattern of the associated mask. Finally, a light source is mounted on the rear portion of the panel over the aperture therein. In a further embodiment, a decorative laminate may be applied on the front portion of the panel to cover at least an area of the lens and associated mask. In another further embodiment, each of the one or more three-dimensional figures is mounted flush against the panel.

In a third aspect, a decorative lighting display system includes a panel having a recess formed in a front portion thereof. The panel has an aperture formed in a portion of the recess from the front portion of the panel to a rear portion thereof. The system also includes a lens mounted in the recess in the panel. The lens includes a mask formed thereon. The mask is configured to have a predetermined pattern. The system also includes one or more three-dimensional figures mounted to the panel over the lens and associated mask. The one or more three-dimensional figures have a two-dimensional cross-section, in a plane parallel to the front portion of the panel, which is slightly smaller than the predetermined pattern of the mask. The system further includes a light source mounted on the rear portion of the panel over the aperture therein. The light source includes light elements for directing light through the lens and associated mask.

The features, functions, and advantages that have been discussed can be achieved independently in various embodiments or may be combined in yet other embodiments, further details of which can be seen with reference to the following description and drawings.

BRIEF DESCRIPTION OF THE DRAWINGS

The following detailed description, given by way of example and not intended to limit the present disclosure solely thereto, will best be understood in conjunction with the accompanying drawings in which.

DETAILED DESCRIPTION

In the present disclosure, like reference numbers refer to like elements throughout the drawings, which illustrate various exemplary embodiments of the present disclosure.

Figure 1:
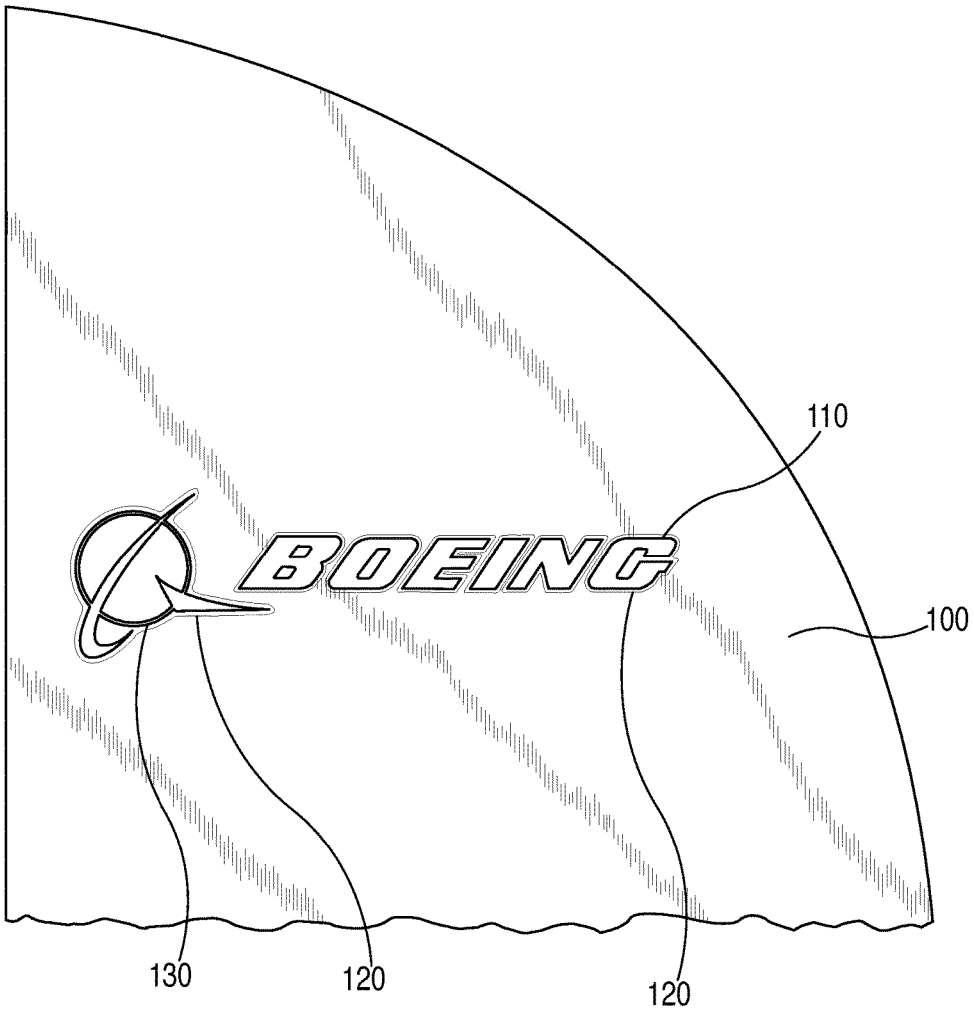
FIG. 1 is front view of a panel having three-dimensional figures mounted thereto which shows the halo backlighting effect generated according to the system and method of the present disclosure.

Referring now to FIG. 1, a panel 100 includes a plurality of three-dimensional figures including three-dimensional letters 110 that spell out "BOEING" and the associated three-dimensional symbol 130 (together forming the well-known Boeing logo) which are mounted to panel 100 as discussed below. Panel 100 is configured, in a manner discussed below, to create a halo lighting effect 120 around each letter 110 and symbol 130 without mounting a lighting assembly between panel 100 and each letter 110 and symbol 130 as in conventional lighting displays. The system and method of the present disclosure are used in FIG. 1 to create a halo lighting effect around the Boeing logo, however, as one of ordinary skill in the art will readily recognize, this system and method can be applied to any type of three-dimensional figure including one or more letters, numbers and/or symbols. A halo lighting effect is created around three-dimensional figures mounted to a panel as discussed in detail below.

Figure 2:
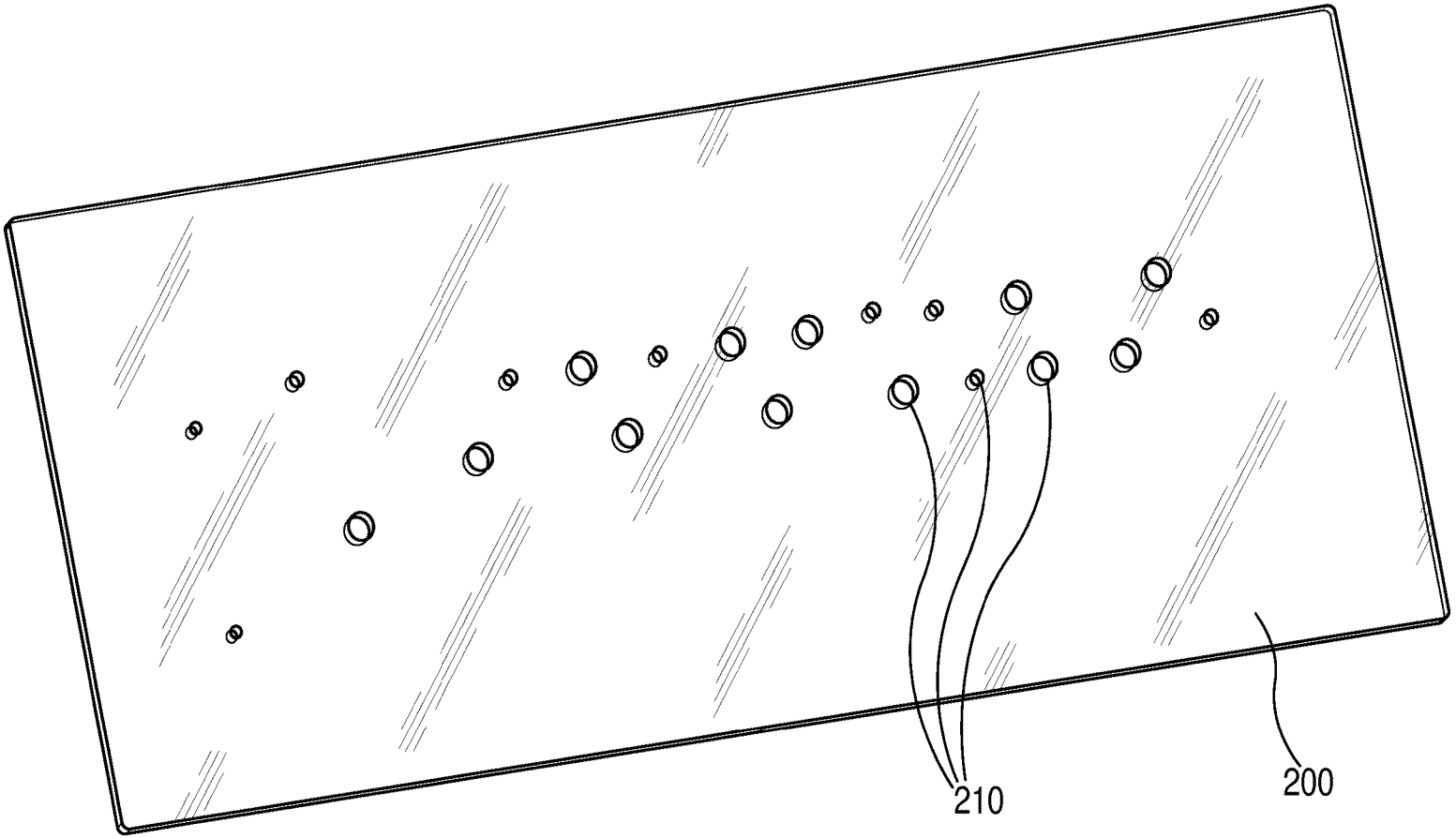
FIG. 2 is a front view of a lens assembly used in the system and method of the present disclosure.
Figure 3:
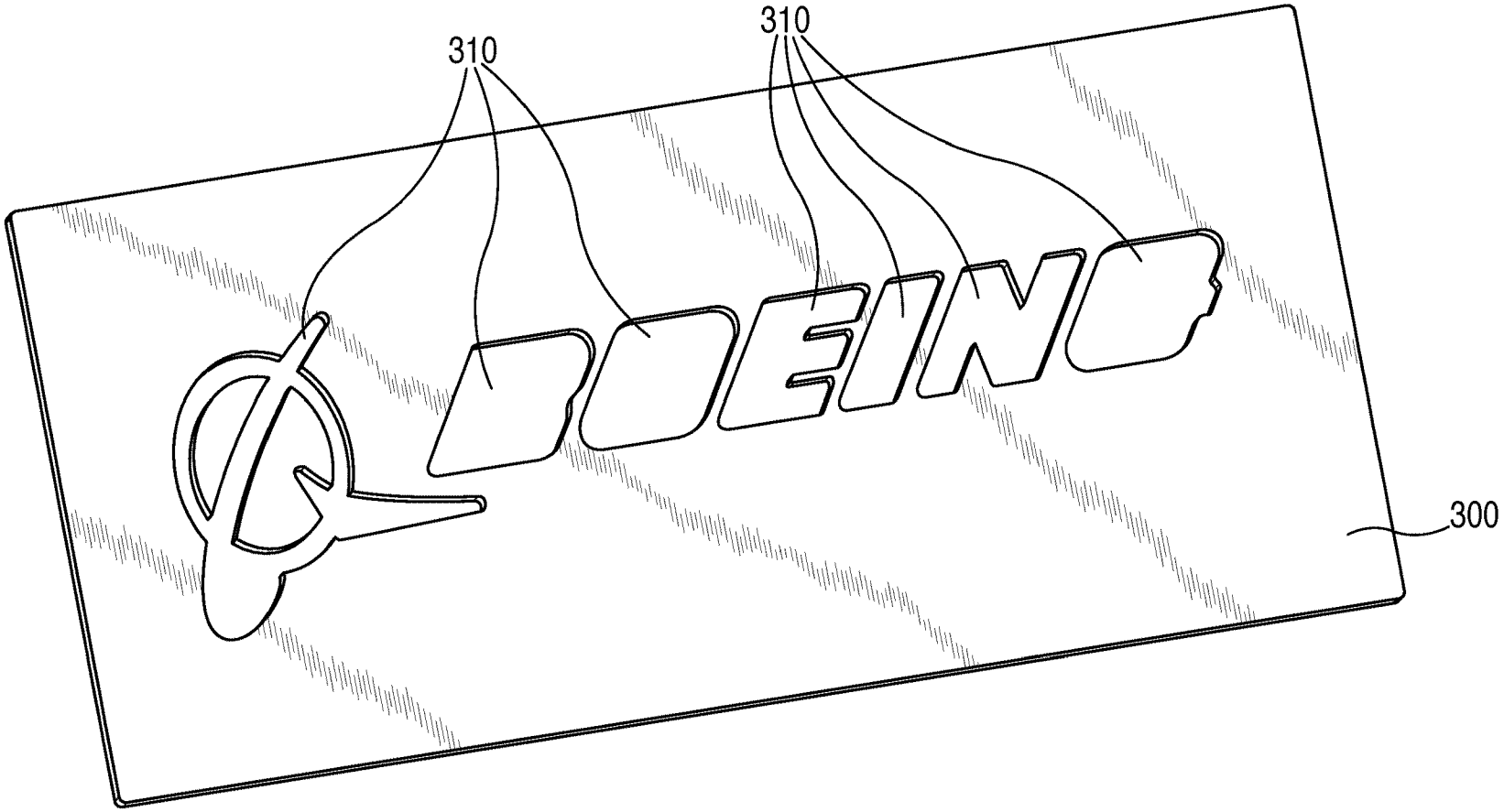
FIG. 3 is a front view of a masking layer used the system and method of the present disclosure.

Referring now to FIG. 2, a lens 200 is preferably constructed from a clear, rigid plastic material which may include holes 210 pre-drilled therein for mounting the selected three-dimensional figures (here the Boeing logo). As one of ordinary skill in the art will readily recognize, other types of materials may also be used to construct lens 200. A masking layer (mask) 300 shown in FIG. 3 has the same outer dimensions as lens 200 and is formed from an opaque material (e.g., a thin aluminum sheet) which is affixed to the plastic lens 200 shown in FIG. 2. The masking layer 300 is constructed such that light is allowed to pass through only in select areas 310 (in this case the mask allows light to pass only through an area slightly larger than the outer dimensions of the selected three-dimensional figures). Masking layer 300 may be affixed to lens 200 with an adhesive or with mechanical fasteners, or may be, in the alternative, press-fit against lens 200 during assembly, as discussed below. In an alternative embodiment, masking layer 300 may be formed directly on lens 200 using, for example, black paint.

Figure 4:
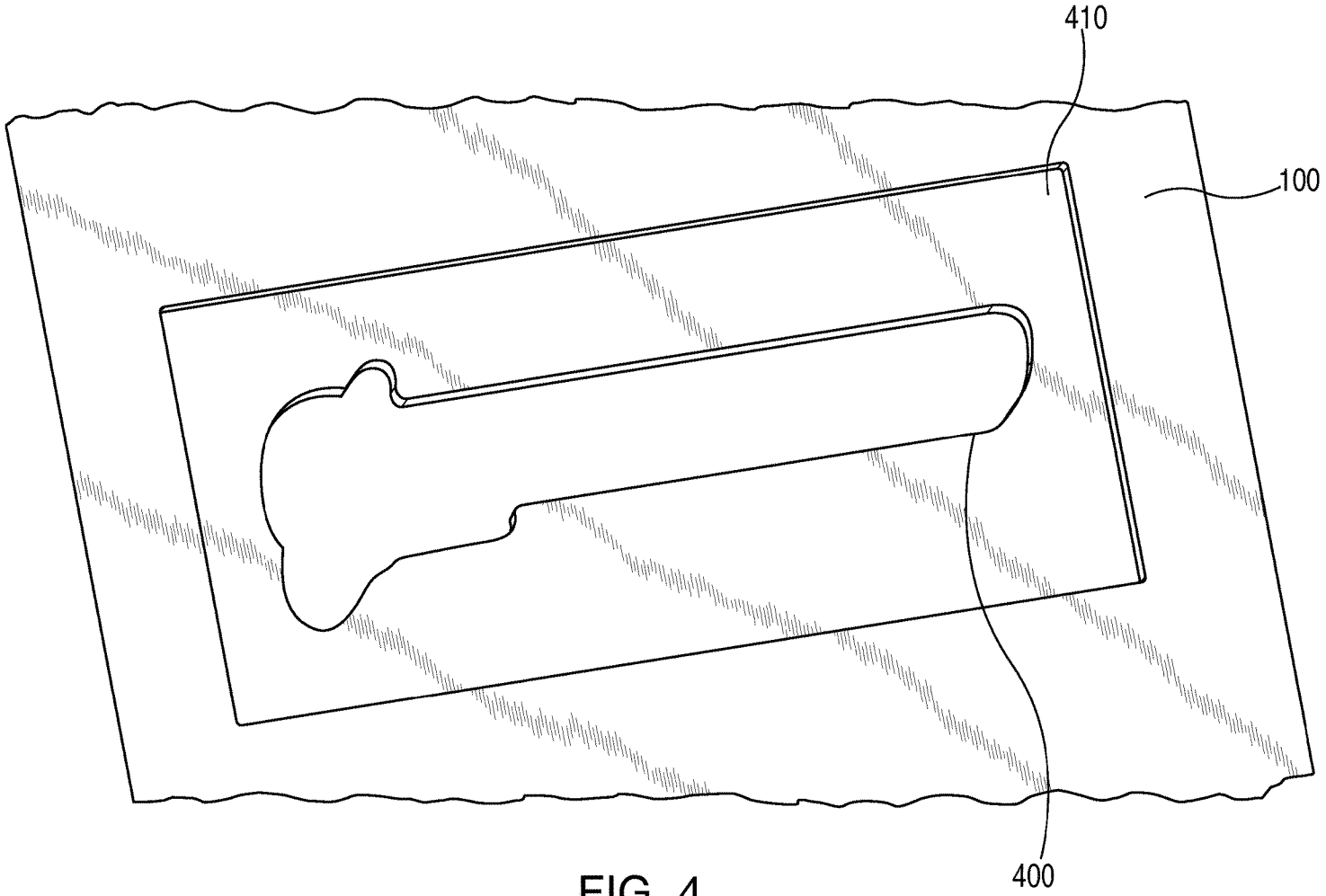
FIG. 4 is a front view showing a recess and through cutout in a panel for mounting three-dimensional figures according to an aspect of the system and method of the present disclosure.

Referring now to FIG. 4, panel 100 is preferably formed from any rigid material which can be routed and cut. In a presently preferred embodiment for use on airlines, panel 100 is formed from a honeycomb material having an internal foam area. However, as one of ordinary skill in the art will readily recognize, almost any type of rigid material may be used. Panel 100 is preferably machined or routed to produce a shallow recess 410 designed to hold the lens 200 and masking layer 300, although, as one of ordinary skill in the art will readily recognize, the recess 410 may be formed in many other ways. Panel 100 also includes a through cutout 400 (i.e., an aperture) in a portion of recess 410 that allows light from a light box mounted on the rear of panel 100, as discussed below, to reach the lens 200 and masking layer 300.

Figure 5:
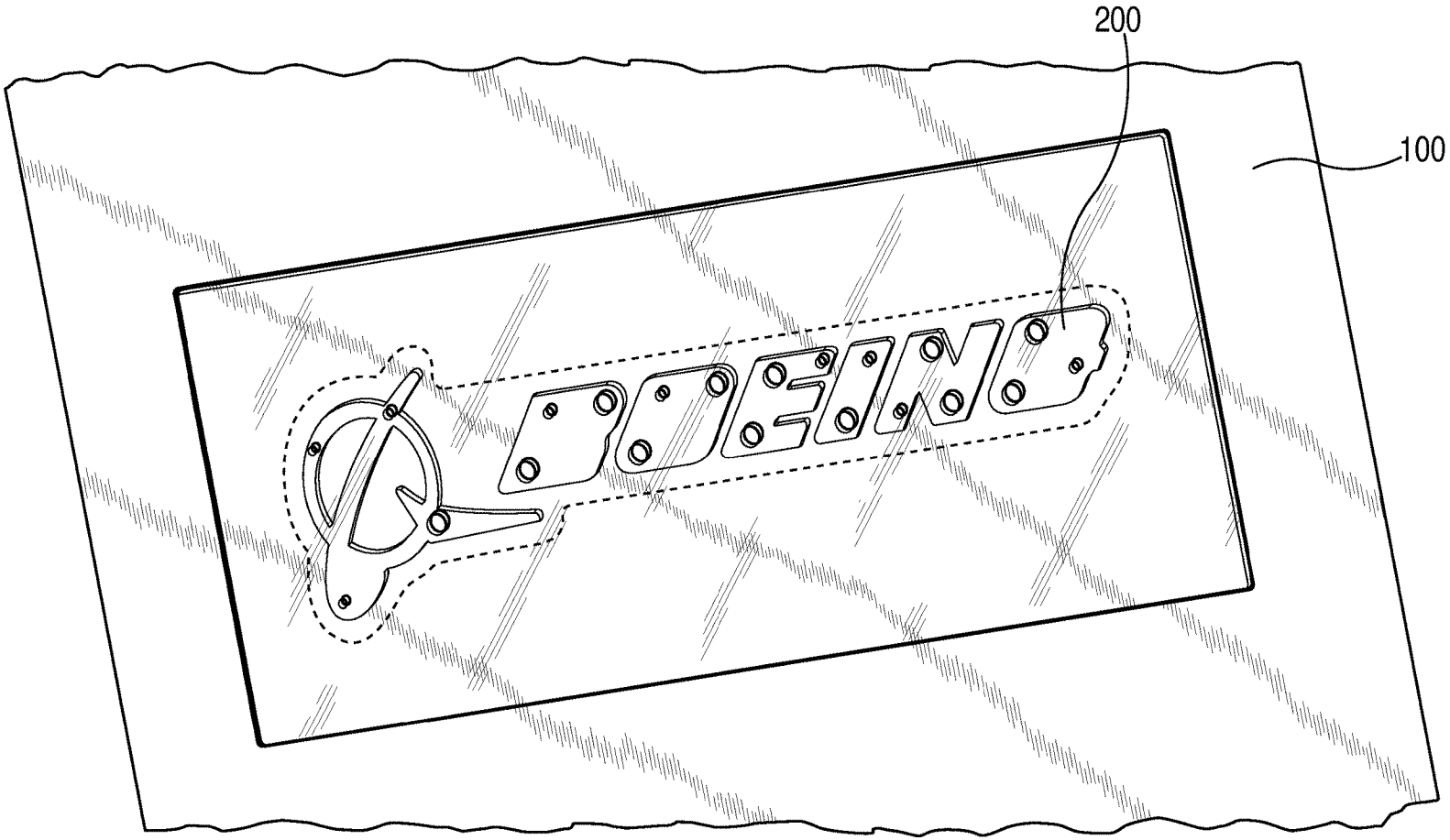
FIG. 5 is a front view showing a lens assembly and masking layer mounted in a through cutout in a panel for mounting three-dimensional figures according to an aspect of the system and method of the present disclosure.
Figure 6:
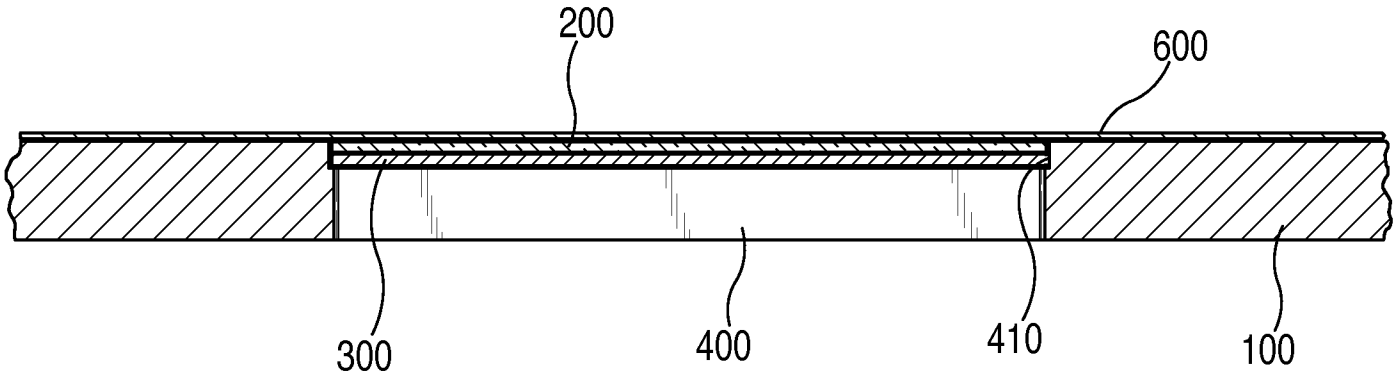
FIG. 6 is a cross-sectional view of the panel shown in FIG. 5 after the decorative laminate is applied over a front surface thereof according to an aspect of the system and method of the present disclosure.

Referring now to FIGS. 5 and 6, lens 200 and associated masking layer 300 may be bonded with an appropriate adhesive or fastened with fasteners into the recess 410 in panel 100, although in some situations, the lens 200 and masking layer 300 may be press-fit into recess 410 and held securely without any adhesive or fasteners. After lens 200 and masking layer 300 are installed, a decorative laminate 600 may be applied over the outer surface of panel 100. Decorative laminate 600 conceals the lens 200 from view and causes panel 100 to appear unmodified. As one of ordinary skill in the art will readily recognize, decorative laminate may cover the entire front surface of panel 100, may cover selected portions thereof (e.g., the front surface of lens 200) or, in some cases, may be omitted. The decorative laminate may be, for example, a wall-covering product (e.g., wallpaper) which allows at least some light to pass through. In a further embodiment, fairing compound may be applied to the seam between lens 200 and panel 100 and then sanded to create a flat and level surface onto which decorative laminate 600 is applied. After the application of the decorative laminate 600 (if not omitted), the selected three-dimensional FIGS. 110, 130 (shown in FIG. 1) are then be installed onto the front of panel 100, preferably using mounting holes 210 (FIG. 2) in lens 200.

Figure 7:
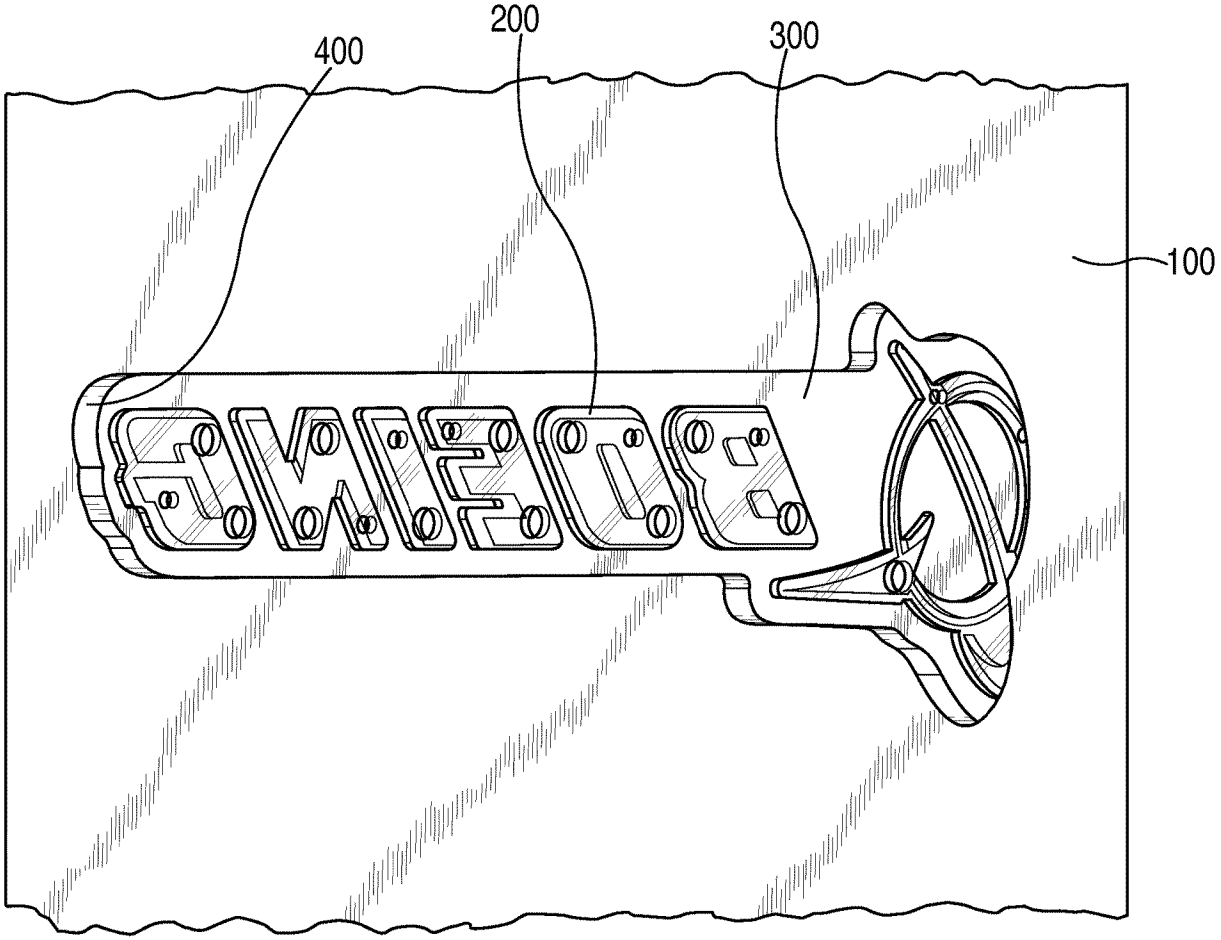
FIG. 7 is a rear perspective view of the panel shown in FIG. 5 showing a cut-out area behind the lens assembly and masking layer according to an aspect of the system and method of the present disclosure.
Figure 8:
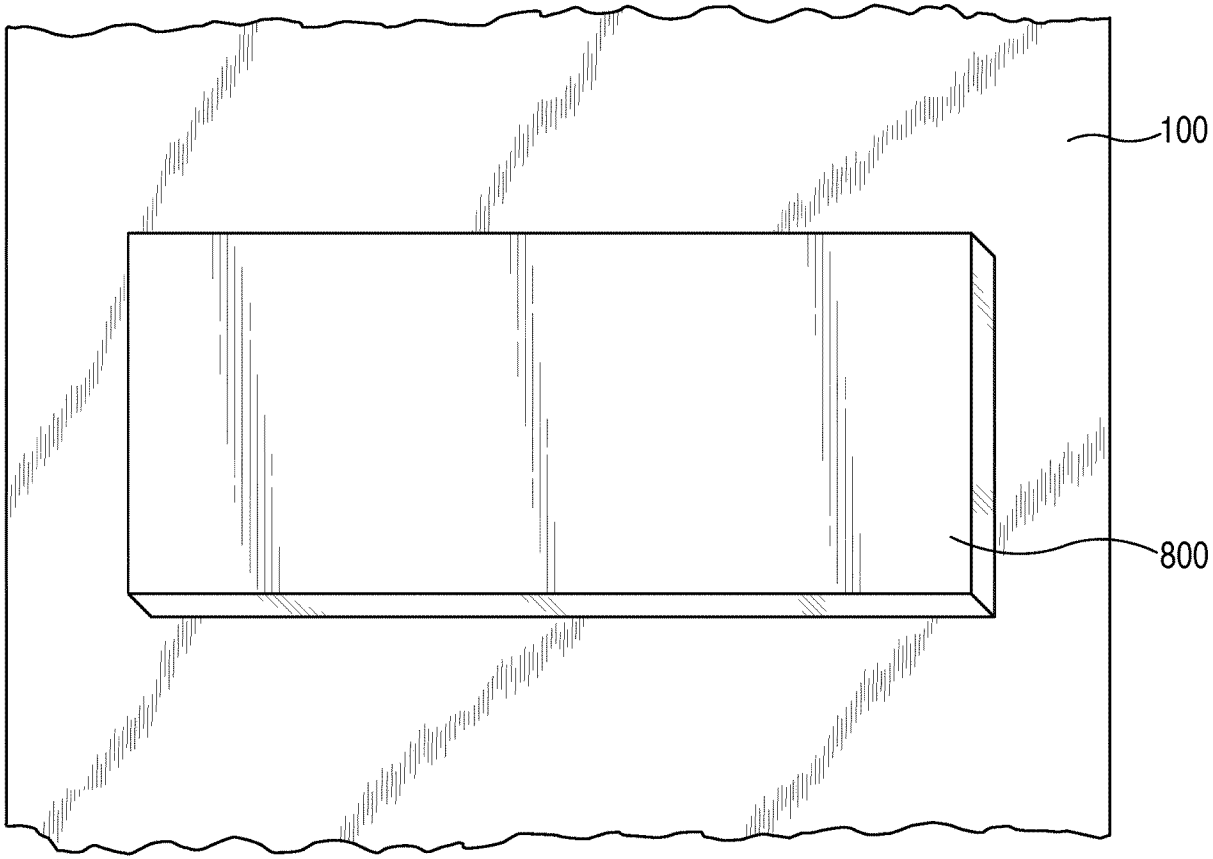
FIG. 8 a rear perspective view of the panel shown in FIG. 5 after a light box has been mounted thereto according to an aspect of the system and method of the present disclosure.

Referring now to FIG. 7, a rear view of panel 100 is shown after installation of lens 200 and masking layer 300 therein, with lens 200 and masking layer 300 visible through the cutout area 400. As shown in FIG. 8, a light box 800 is preferably then affixed to the back of the panel 100 over the cutout area 400 (seen in FIG. 7 but covered by light box 800 in FIG. 8). Light from light box 800 passes through the lens 200, illuminating the decorative laminate 600 around the three-dimensional figures thereby creating the desired halo effect 120 around each of the three-dimensional FIGS. 110, 130 as shown in FIG. 1. The desired halo effect is thus produced in a different way than conventional systems and without using expensive neon light fixtures. In addition, the system and method of the present disclosure may be applied to three-dimensional figures much smaller than may be used in conventional systems that are limited by the size of the neon (or incandescent or florescent) lighting devices. Further, the system and method of the present disclosure can provide a smaller and more compact decorative lighting display, because the three-dimensional FIGS. 110, 130 may be applied very close and even flush against the mounting panel 100 as shown in FIG. 1. This provides a distinct advantage over conventional lighting systems which, as discussed above in the Background, require lighting elements positioned between a three-dimensional figure and a mounting panel.

Figure 9:
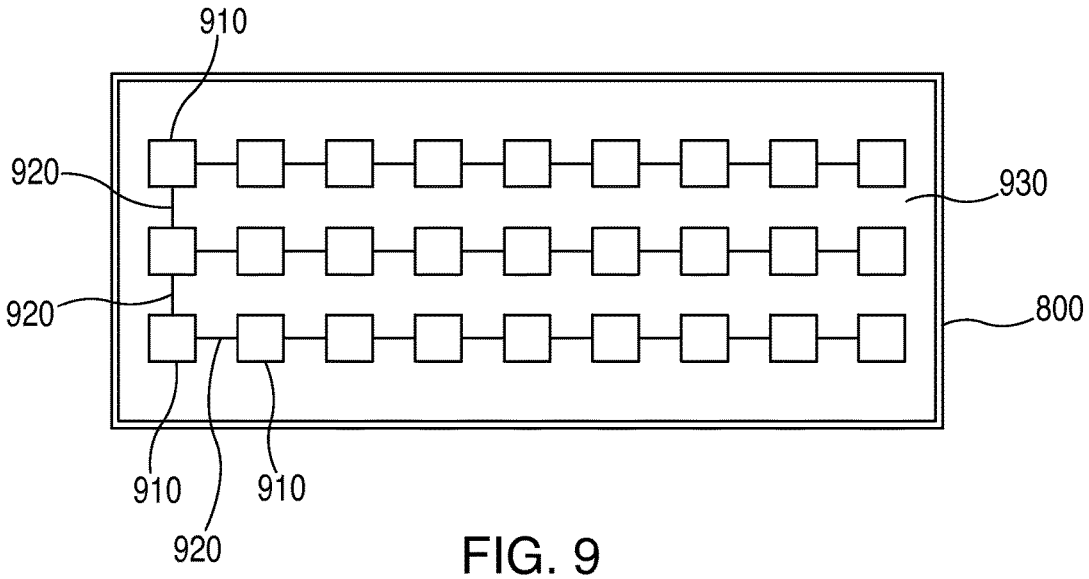
FIG. 9 is a front view of a light box according to an aspect of the system and method of the present disclosure.

Light box 800 is shown in FIG. 9 and includes a series of lighting elements 910, e.g., LEDs, coupled together with power leads 920, with the lighting elements 910 mounted on an inner reflective surface 930 of light box 800. In operation, as shown in FIG. 1, when light box 800 is activated, the desired halo effect 120 is produced. Different colors can be produced for the halo effect 120 by either using colored LED elements 910 or by using white light LED elements 910 and adding a color filter layer to lens 200. As one of ordinary skill in the art will readily recognize, lens 200 may alternatively be formed entirely from a plastic material tinted in the desired color. Still further, a variable color display, for the halo effect 120, may be provided by adding additional LED elements in alternative colors to light box 800, with appropriate control circuitry or by using multicolor LED elements instead of single colored LED elements, and adding appropriate control circuitry.

Although the present disclosure has been particularly shown and described with reference to the preferred embodiments and various aspects thereof, it will be appreciated by those of ordinary skill in the art that various changes and modifications may be made without departing from the spirit and scope of the disclosure. It is intended that the appended claims be interpreted as including the embodiments described herein, the alternatives mentioned above, and all equivalents thereto.

What is claimed is:

1. A decorative lighting display system, comprising:

a panel having a recess formed in a front portion thereof, the panel having an aperture formed in a portion of the recess through a width of the panel from a lower surface of the recess to a rear portion of the panel;

a lens and an associated mask mounted completely within the recess in the panel, the associated mask configured to have a predetermined pattern;

one or more three-dimensional figures mounted to the panel over the lens and associated mask and completely outside of the recess in the panel, the one or more three-dimensional figures having a two-dimensional cross-section, in a plane parallel to the front portion of the panel, that is slightly smaller than the predetermined pattern of the associated mask;

a light source mounted on an outer surface of the rear portion of the panel over and completely outside of the aperture therein, the light source including light elements for directing light through the lens and associated mask; and wherein a halo lighting effect appears around the one or more three-dimensional figures when the light source is activated.

2. The decorative lighting display system of claim 1, further comprising a decorative laminate applied on the front portion of the panel to cover at least an area of the lens and associated mask, the decorate laminate positioned between the lens and associated mask and an inner surface of each of the one or more three-dimensional figures.

3. The decorative lighting display system of claim 2, wherein the decorative laminate covers an area corresponding to an entire front portion of the panel.

4. The decorative lighting display system of claim 1, wherein the one or more three-dimensional figures are mounted flush against the panel over the lens and associated mask.

5. The decorative lighting display system of claim 1, wherein the light elements in the light source are LED devices.

6. The decorative lighting display system of claim 4, wherein the LED devices selectively emit different predetermined colors of light.

7. The decorative lighting display system of claim 1, further comprising a color filter having a predetermined color positioned adjacent to the lens.

8. The decorative lighting display system of claim 1, wherein the lens is formed from a plastic material which is tinted to a predetermined color.

9. The decorative lighting display system of claim 1, wherein the lens includes mounting holes formed therein and wherein the one or more three-dimensional figures are mounted to the panel using the mounting holes in the lens.

10. A method for forming a decorative lighting display, comprising the steps of:

forming a recess in a front portion of a panel;

forming an aperture in a portion of the recess in the panel through a width of the panel from a lower surface of the recess to a rear portion of the panel;

mounting a lens and an associated mask completely within the recess in the panel, the associated mask configured to have a predetermined pattern;

mounting one or more three-dimensional figures to the panel over the lens and associated mask and completely outside of the recess in the panel, the one or more three-dimensional figures having a two-dimensional cross-section, in a plane parallel to the front portion of the panel, that is slightly smaller than the predetermined pattern of the associated mask; and mounting a light source on an outer surface of the rear portion of the panel over and completely outside of the aperture therein so that a halo lighting effect appears around the one or more three-dimensional figures when the light source is activated.

11. The method for forming a decorative lighting display of claim 10, further comprising the step of, prior to the step of mounting one or more three-dimensional figures to the panel, applying a decorative laminate on the front portion of the panel to cover at least an area of the lens and associated mask, and wherein the decorate laminate is between the lens and associated mask and an inner surface of each of the one or more three-dimensional figures after each of the one or more three dimensional figures is mounted to the panel.

12. The method for forming a decorative lighting display of claim 10, wherein the step of mounting one or more three-dimensional figures to the panel over the lens and associated mask mounts each of the one or more three-dimensional figures flush against the panel.

13. A decorative lighting display system, comprising:

a panel having a recess formed in a front portion thereof, the panel having an aperture formed in a portion of the recess through a width of the panel from a lower surface of the recess to a rear portion of the panel;

a lens mounted completely within the recess in the panel, the lens including a mask formed thereon, the mask configured to have a predetermined pattern;

one or more three-dimensional figures mounted to the panel over the lens and mask and completely outside the recess in the panel, the one or more three-dimensional figures having a two-dimensional cross-section, in a plane parallel to the front portion of the panel, that is slightly smaller than the predetermined pattern of the mask;

a light source mounted on an outer surface of the rear portion of the panel over and completely outside of the aperture therein, the light source including light elements for directing light through the lens and mask; and wherein a halo lighting effect appears around the one or more three-dimensional figures when the light source is activated.

14. The decorative light display system of claim 13, further comprising a decorative laminate applied on the front portion of the panel to cover at least an area of the lens, the decorate laminate positioned between the lens and an inner surface of each of the one or more three-dimensional figures.

15. The decorative lighting display system of claim 14, wherein the decorative laminate covers an area corresponding to an entire front portion of the panel.

16. The decorative lighting display system of claim 13, wherein the one or more three-dimensional figures are mounted flush against the panel over the lens and associated mask.

17. The decorative lighting display system of claim 13, wherein the light elements in the light source are LED devices which selectively emit different predetermined colors of light.

18. The decorative lighting display system of claim 13, further comprising a color filter having a predetermined color positioned adjacent to the lens.

19. The decorative lighting display system of claim 13, wherein the lens is formed from a plastic material which is tinted to a predetermined color.

20. The decorative lighting display system of claim 13, wherein the lens includes mounting holes formed therein and wherein the one or more three-dimensional figures are mounted to the panel using the mounting holes in the lens.

* * * * *